US010032402B2

(12) United States Patent
Kempf

(10) Patent No.: US 10,032,402 B2
(45) Date of Patent: Jul. 24, 2018

(54) POWER AND BRIGHTNESS MANAGEMENT OF SOLID-STATE DISPLAYS

(71) Applicant: Texas Instruments Incorporated, Dallas, TX (US)

(72) Inventor: Jeffrey Matthew Kempf, Allen, TX (US)

(73) Assignee: TEXAS INSTRUMENTS INCORPORATED, Dallas, TX (US)

( * ) Notice: Subject to any disclaimer, the term of this patent is extended or adjusted under 35 U.S.C. 154(b) by 96 days.

(21) Appl. No.: 14/803,439

(22) Filed: Jul. 20, 2015

(65) Prior Publication Data

US 2016/0027365 A1 Jan. 28, 2016

Related U.S. Application Data

(60) Provisional application No. 62/028,154, filed on Jul. 23, 2014.

(51) Int. Cl.

| | |
|---|---|
| ***G09G 3/22*** | (2006.01) |
| ***G09G 3/20*** | (2006.01) |
| *G09G 5/02* | (2006.01) |
| *G09G 3/32* | (2016.01) |

(52) U.S. Cl.

CPC ..... *G09G 3/2003* (2013.01); *G09G 5/02* (2013.01); *G09G 2320/0666* (2013.01); *G09G 2330/021* (2013.01); *G09G 2340/06* (2013.01); *G09G 2340/16* (2013.01); *G09G 2360/16* (2013.01); *G09G 2360/18* (2013.01)

(58) Field of Classification Search

CPC ..... G09G 3/2003; G09G 5/02; G09G 2320/0666; G09G 2330/021; G09G 2340/06; G09G 2360/16; G09G 3/3607; G09G 1/28; G09G 5/026; G09G 2320/0693; G09G 2320/0673; G09G 2340/14; G09G 2360/18; G09G 2360/127; G09G 2360/121; G09G 2360/12; G09G 2360/10; G09G 2360/08; G09G 2340/16; G09G 2340/00; G09G 2360/128

See application file for complete search history.

(56) References Cited

U.S. PATENT DOCUMENTS

| | | | | |
|---|---|---|---|---|
| 4,549,212 A * | 10/1985 | Bayer | G06T 5/001 | 348/618 |
| 4,561,022 A * | 12/1985 | Bayer | H04N 1/409 | 348/622 |
| 5,410,617 A * | 4/1995 | Kidd | G06K 9/38 | 358/466 |
| 5,774,593 A * | 6/1998 | Zick | G06K 9/00711 | 375/E7.151 |
| 7,003,518 B2 * | 2/2006 | Lee | G06F 17/3025 | |
| 7,349,574 B1 * | 3/2008 | Sodini | G06T 5/009 | 345/589 |

(Continued)

*Primary Examiner* — Julie Anne Watko

(74) *Attorney, Agent, or Firm* — Michael A. Davis, Jr.; Charles A. Brill; Frank D. Cimino

(57) ABSTRACT

System, method, and device for maximizing brightness of solid-state illuminators while minimizing power usage based on individual scene contents. An embodiment varies power to each of the solid-state illuminators (red, green, & blue) based on the scene content that is being displayed optimizing the non-linear brightness response of solid-state illuminators.

17 Claims, 4 Drawing Sheets

(56) References Cited

U.S. PATENT DOCUMENTS 7,847,782 B2 * 12/2010 Sohn ..... G09G 3/3406 345/102
7,924,261 B2 * 4/2011 Kerofsky ..... G09G 3/22 345/102
7,982,827 B2 7/2011 Clatanoff et al.
8,223,113 B2 * 7/2012 Kerofsky ..... G09G 3/3413 345/102
8,253,755 B2 8/2012 Russell et al.
8,305,387 B2 11/2012 Russell et al.
8,525,934 B2 * 9/2013 Okui ..... G09G 3/20 348/687
8,674,926 B2 * 3/2014 Nitta ..... G09G 3/3426 345/102
2003/0201968 A1 * 10/2003 Itoh ..... G09G 3/3611 345/102
2003/0218432 A1 * 11/2003 Song ..... G09G 3/2944 315/169.1
2004/0160439 A1 * 8/2004 Xavier ..... G06T 3/403 345/419
2006/0262111 A1 * 11/2006 Kerofsky ..... G09G 3/22 345/211
2006/0267923 A1 * 11/2006 Kerofsky ..... G09G 3/22 345/102
2007/0025683 A1 * 2/2007 Nobori ..... G09G 3/3611 385/147
2007/0092139 A1 * 4/2007 Daly ..... G09G 3/3406 382/169
2007/0146236 A1 * 6/2007 Kerofsky ..... G09G 3/3406 345/7
2007/0247391 A1 * 10/2007 Someya ..... G09G 3/3406 345/7
2007/0268524 A1 * 11/2007 Nose ..... G09G 3/2007 358/3.01
2008/0037867 A1 * 2/2008 Lee ..... H04N 9/68 382/168
2008/0088650 A1 * 4/2008 Chen ..... G09G 3/2025 345/690
2008/0094346 A1 * 4/2008 De Greef ..... G09G 3/3406 345/102
2008/0100645 A1 * 5/2008 Nitta ..... G09G 3/3426 345/690
2008/0129679 A1 * 6/2008 Yamamoto ..... G09G 3/3406 345/102
2009/0167751 A1 * 7/2009 Kerofsky ..... G09G 3/3406 345/214
2009/0201320 A1 * 8/2009 Damberg ..... G09G 3/3426 345/694
2010/0277518 A1 * 11/2010 Oh ..... G09G 3/3406 345/690
2010/0328535 A1 * 12/2010 Okui ..... G09G 3/20 348/578
2011/0001807 A1 * 1/2011 Myokan ..... H04N 13/0438 348/56
2011/0293176 A1 * 12/2011 Abe ..... H04N 19/14 382/165
2013/0021363 A1 * 1/2013 Nobori ..... G09G 3/3611 345/589
2014/0240201 A1 * 8/2014 Takahashi ..... G06F 3/1446 345/1.3
2015/0109346 A1 * 4/2015 Taniguchi ..... G09G 3/3406 345/690
2016/0140924 A1 * 5/2016 Heo ..... G09G 3/2003 345/690

* cited by examiner

POWER AND BRIGHTNESS MANAGEMENT OF SOLID-STATE DISPLAYS

CROSS-REFERENCE TO RELATED APPLICATIONS

This application claims priority to the U.S. provisional patent application Ser. No. 62/028,154, filed Jul. 23, 2014, the entirety of which is hereby incorporated herein by reference for all purposes.

TECHNICAL FIELD

This invention relates generally to the field of image display systems and more specifically to a system and method for optimizing power usage for solid-state image displays.

BACKGROUND

Sequential color display systems such as Digital Micromirror Devices (DMD) and others use solid state illuminators such as LEDs, with fixed duty cycles and minimal current variation to adjust the brightness of images. One such approach involves varying duty cycles of illuminators and overlapping primary colors of the image. This requires high fidelity control of the time line resulting in more bit planes and a complicated display driver with excess power consumption due to additional switching. To overlap primary colors, more than one illuminator at any given instance must be powered up resulting in instantaneous power draw increases and requiring a complex and expensive power supply scheme.

Another approach involves varying the intensity of solid state illuminators. This approach is based on an assumption of linear brightness response of solid state illuminators; however, these solid-state illuminators do not have linear response relationship between applied power and brightness. The linear relationship approach requires constant power usage and produces non-optimal image brightness and color drift. In this approach, the white point of the image varies as the currents are linearly adjusted. Various different approaches and related background is described in U.S. Pat. Nos. 7,982,827, 8,253,755, and 8,305,387 the descriptions of which are incorporated herein in its entirety by reference for all purposes.

SUMMARY

In accordance with an embodiment, a method for maximizing brightness of solid-state illuminators is provided. The method includes calculating a clipping threshold for each color component of an image of a current frame of an incoming video signal based on energy of each color component, filtering the clipping threshold to generate a filtered clipping threshold; and determining a power level and a gain level for an output video signal based on the filtered clipping threshold.

In accordance with an embodiment, a device is provided. The device comprises a histogram unit, configured to calculate a clipping threshold for each color component of an image of a current frame of an incoming video signal based on energy of each color component; a filter coupled to the histogram unit, configured to filter the clipping threshold to generate a filtered clipping threshold; and a power gain calculator coupled to the filter, configured to determine a power level and a gain level for an output video signal based on the filtered clipping threshold.

In accordance with an embodiment, a display system is provided. The display system comprises a processor configured to compute a histogram of energy of each color component of an image of a current frame of an incoming video signal, calculate a clipping threshold for each color component of the image of the current frame of the incoming video signal based on the histogram, and determine an output power level and output gain level for an output video signal based on the clipping threshold; and a display unit, configured to display the output video signal based on the output power level and the output gain level.

DETAILED DESCRIPTION

The following description provides many different embodiments, or examples, for implementing different features of the subject matter. These descriptions are merely for illustrative purposes and do not limit the scope of the invention.

Generally, in solid-state displays, illuminators are powered based on the required brightness of a given scene assuming linear relationship between the applied power and resulting brightness of solid-state illuminators. Typically, the power supplied to solid-state illuminators is clipped for a given scene and remains constant for all frames of the given scene. The clipping artifacts become visible on the screen for dark content of the scene and the image quality degrades.

The present disclosure provides an exemplary embodiment for per frame power management using overall energy clipping for each frame of a scene to generate a color sequence of light for modulation by pixel modulators of a spatial light modulator (SLM) in the display of images for a scene. The SLMs are individually set in synchronization with variations in the light sequence from the illuminators and responsive to position setting signals developed from remotely or locally generated image pixel color and intensity (hue and saturation) data. The power of each illuminator is varied based on scene content for the image to be projected and on user-defined maximum gain.

The exemplary embodiment provides a programmable continuum between high brightness and low power. The power to each of the solid-state illuminators (red, green, & blue) is varied based on the scene content that is being displayed for each frame. Additionally, it accounts for non-linear brightness response of typically employed solid-state illuminators. Power to illuminators is varied to decrease power draw and/or increase brightness based on scene content, taking into account the nonlinear nature of the illuminators. The non-linear optimization is addressed on a per frame basis for each scene based on the image content. All brightness measurements are stored in a power/intensity look-up table (LUT) and tables are constantly updated based on brightness measurements of each frame. A low power mode is achieved by setting brightness gain to unity, and a high brightness mode is achieved by setting power to nominal power and setting brightness gain to a large value. Changes in power/intensity relationship due to temperature variability and/or poor heat management may be accounted for by measuring the brightness of each illuminator for the desired drive current during modulator "OFF" times and digitally attenuating each color channel to normalize brightness.

Figure 1:
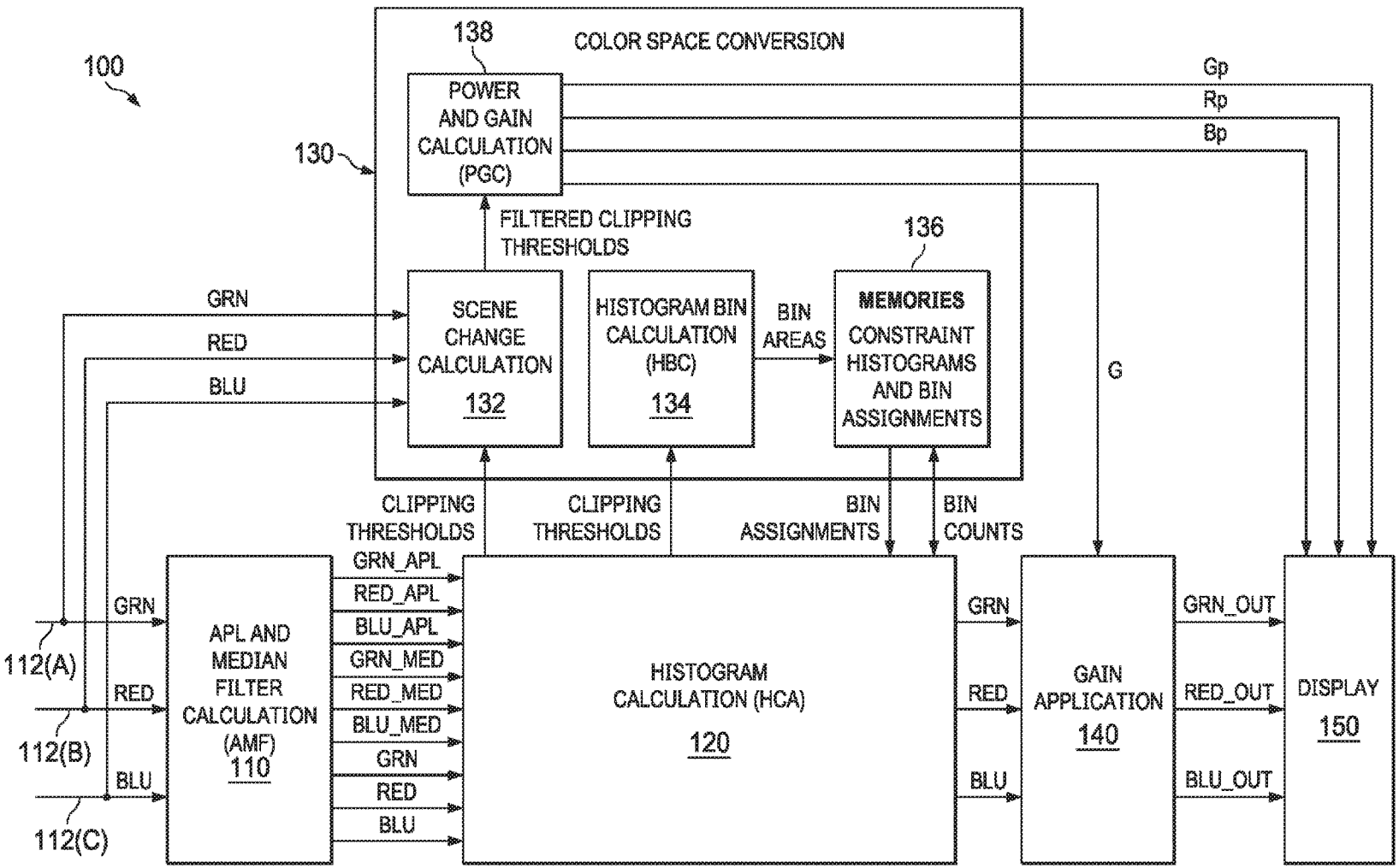
FIG. 1 is a component block diagram of an exemplary system implementation according to some embodiment.

Referring to FIG. 1, a block diagram for an exemplary implementation of System 100 is shown. System 100 typically operates during vertical blanking period of an associated display unit. The System 100 includes an Average Picture Level (APL) and median filter calculator unit 110. Unit 110 receives incoming image color streams Green 112*a*, Red 112*b*, and Blue 112*c* for a frame of a given scene. APL Unit 110 processes incoming color image streams and generates output color stream values GRN_APL, RED_APL, and BLU_APL based on the average intensity of each color over the entire input frame. Further, APL Unit 110 filters the incoming colors of image to calculate a horizontal median of power based on a pixel-by-pixel basis for each color and generates values GRN_MED, RED_MED, and BLU_MED. APL Unit 110 calculates the average/median value of primary color values in a given single frame/image. For example, if the input value of a given primary color is determined to be [208 231 32 233 166] then the sorted input values will be [32 161 208 231 233]. The APL Unit 110 filters the video stream and each individual pixel is replaced with median of itself and nearest values. In an embodiment, the APL Unit 110 uses the median of the pixel and nearest four values. 4 neighbors. One skilled in the art will appreciate that these values can be selected in various different ways such as mean, median, average, absolute, and the like depending on a given application. APL Unit 110 also passes through incoming image colors 112(*a*)-(*c*) without processing for further evaluation by other units of system 100. These output color values are used to calculate an energy clipping amount for the frame. APL Unit 110 filters the incoming image color stream to avoid spurious pixels from skewing the histogram results. These filtered signals are used in the subsequent histogram calculation.

The output of APL Unit 110 is input to a Histogram Calculation (HCA) Unit 120. HCA Unit 120 preferably computes histogram of all input values on a frame-by-frame basis. In HCA Unit 120, N bins are employed per each color component, where N<<[bit depth of color component]. Initially, these bins are equally spaced across the dynamic range of the corresponding color component. For an entire frame, the histogram of each median filtered color component is calculated and clipping thresholds are found. The Histogram Unit 120 generates clipping thresholds for each of the three primary colors. The three clipping thresholds are used to calculate new binning ranges for the subsequent frame.

The clipping threshold calculated by the Histogram Unit 120 are input to a Color Space Conversion (CSC) Unit 130. CSC Unit 130 can be any general purpose processor, Digital Signal Processor (DSP) or similar processing unit. CSC Unit 130 includes a Scene Change Calculation (SCC) Unit 132. The SCC Unit 132 calculates a scene change coefficient, described below, based on the absolute difference of clipping threshold values of the current frame and a previous frame. The scene change coefficient is stored in a lookup table in the memory unit 136 for future reference. The SCC Unit 132 provides clipping threshold values to be used for the current frame to a Power and Gain Calculation (PGC) Unit 138. The SCC Unit 132 also calculates a dynamic histogram of RGB input 112 color values. In convention histogram binning, a signal is either binned at its full precision, e.g., 256 bins for an 8-bit signal, or bins are simply combined due to memory constraints e.g., 32 bins are created using only the upper five bits of an 8-bit input signal.

The SCC Unit 132 uses a simple, fixed histogram bin scheme. According to an embodiment, SCC Unit 132 calculates a single 8-bit luminance (or hue) value for each input pixel. It then parses the 8-bit luminance (or hue) into 16 bins: 0-15, 16-31, . . . , 240-255. The summed absolute difference between the current and previous frame's histograms is used as an input to a look-up table in memory 136 that produces a scene change coefficient (between 0 and 1). This coefficient is used in a temporal recursive filtering algorithm described below that is applied to the clipping thresholds. When there is a large summed absolute difference signifying a scene change, the recursive coefficient will be close to zero, and the recursive filtering produces results that are heavily biased towards the current frame. Conversely, when there is a small summed absolute difference, the recursive coefficient will be close to one, and the recursive filtering produces results that are heavily biased towards the previous frame. Histogram Unit 120 calculates the clipping thresholds dynamically incorporating the binning described hereinabove. The objective is to have high precision around the previous frame's clipping thresholds. Subsequent bins and their corresponding widths can be calculated based on a programmable distribution. Luminance values are distributed according to the difference in intensities of pixels. Distribution techniques such as exponential distribution and others can used. The objective is to keep the high precision of distribution. Once the luminance values are distributed in the dynamic histogram, the resolution of the image can be determined.

Filtered clipping threshold values are then input to a Power and Gain Calculation (PGC) Unit 138, which uses the filtered clipping threshold values to generate power Gp, Rp, and Bp for each primary color as the current frame intensity. As stated above, if there is no significant difference between the luminance histograms of the current and previous frames, then the SCC Unit 132 will filter the clipping thresholds with a recursive filter that is heavily biased towards the previously generated results.

The PGC Unit 138 also calculates gain required for each primary color and provides the gain to a Gain Application (GA) Unit 140. An exemplary gain calculation algorithm is described later herein below. The GA Unit 140 uses the gain and applies it to primary colors of the incoming image and outputs gains GRN_OUT, RED_OUT, and BLU_OUT for each primary color needed for the current frame of the scene to be displayed on a display unit 150. A Histogram Bin Calculation (HBC) Unit 134 receives clipping thresholds from the HCA Unit 120 and calculates bin areas for each histogram as explained below. The bin areas calculated by the HBC Unit 134 are then stored into a Memory 136. Memory 136 also stores Lookup Table, and other data such as histograms, bin assignments, bin counts and others. Various units described herein above can be implemented either as independent structural units or can be implemented as software functions in CSC 130. These units can be implemented in a single processing unit programmed to perform various functions. Further, the entire system 100 can be implemented in a processing unit such as a general purpose processor, a DSP, a Microcontroller, a system-on-chip, other processing systems as either individual structural units or software functions, or a combination of multiple units.

Figure 2:
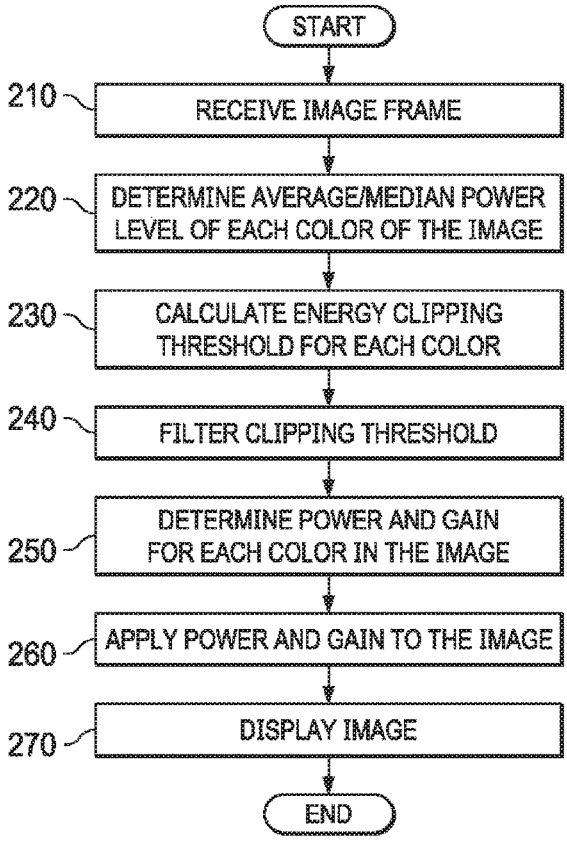
FIG. 2 illustrates an exemplary flow diagram of a process for determining power and gain levels for an image according to some embodiment.

Referring to FIG. 2, an exemplary flow diagram of a process for determining power and gain levels for an image according to some embodiment is provided. At 210 the system receive a frame of an image, which needs to be displayed on a display panel. At 220, the average/median power level of each color in the image is determined. The energy clipping threshold for each color is calculated at 230. The clipping is then filtered based on the clipping threshold of a previous frame using the dynamic histogram technique described herein. At 250, the filtered threshold is then used to determine a power and gain for each color in the image. The calculated power and gain is applied to the image at 260 and the image with updated power and gain is displayed at 270.

Figure 3:
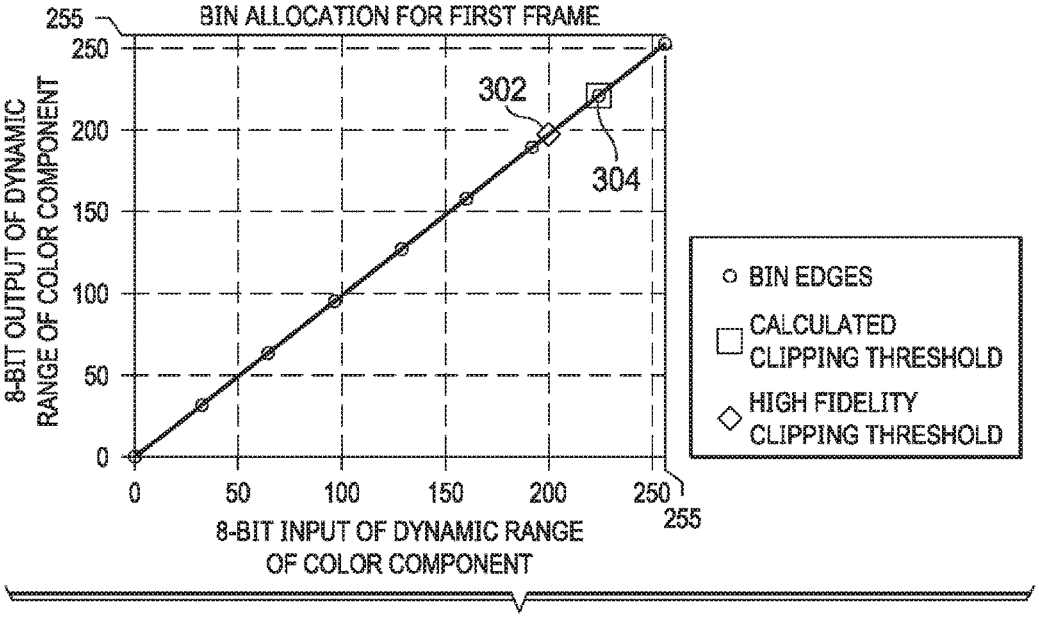
FIG. 3 illustrates bins calculations and their corresponding widths for a first frame of a scene with eight bins and an 8-bit input.
Figure 4:
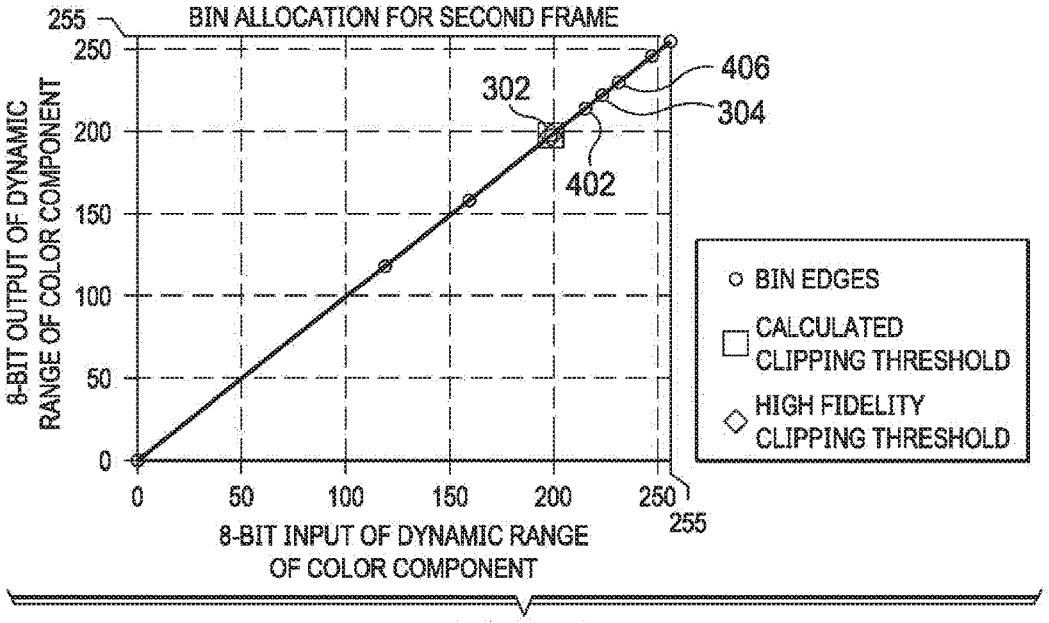
FIG. 4 illustrates bins calculations and their corresponding widths based on Gaussian for a second frame of the scene with eight bins and an 8-bit input
Figure 5:
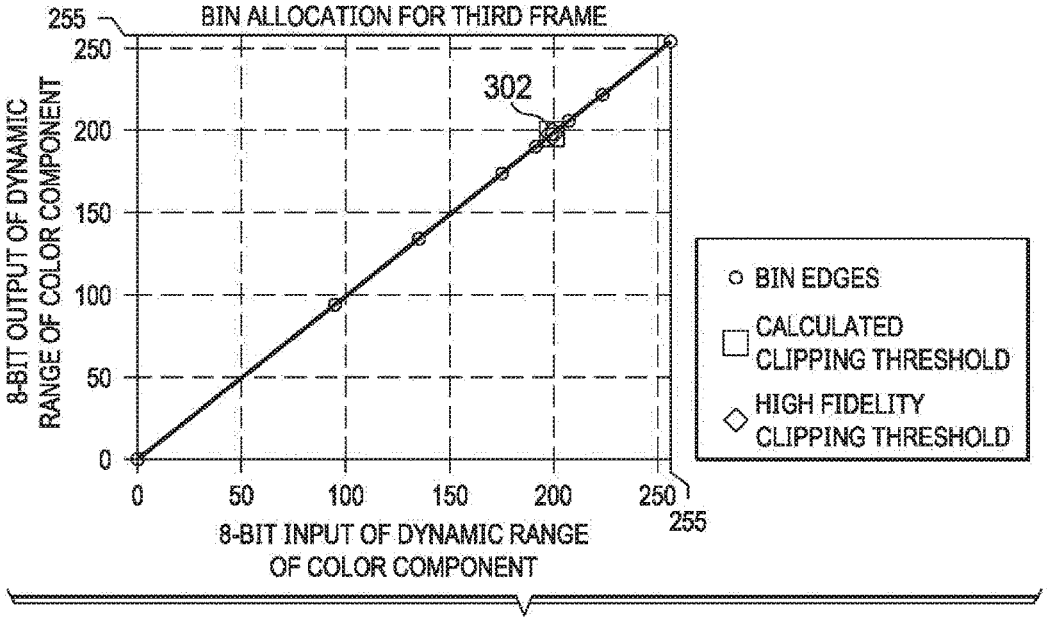
FIG. 5 illustrates bins calculations and their corresponding widths for a third frame of the scene with eight bins and an 8-bit input.

FIGS. 3-5 illustrate an exemplary process for calculating bins and their corresponding widths for eight bins, three frames, and with an 8-bit input. For the illustrated example, the high fidelity clipping threshold is static. In other words, the same image is presented to an algorithm for three consecutive frames. Referring to FIG. 3, at reset, all eight bins are uniformly distributed (equally spaced) for the first frame across the dynamic range of the 256 possible 8-bit values. The high fidelity clipping threshold is the answer that would be achieved if there were 256 bins, and it is shown in this example by a diamond shape that is labelled as 302 in FIG. 3 is represented by a cross. The seventh bin is closest to this result, so its upper edge (whose value equals 223) is chosen as the first estimate (i.e., the first frame's calculated clipping threshold), which is shown by a square shape that is labelled as 304 in FIG. 3. Referring to FIG. 4, an exemplary output of dynamic histogram techniques is illustrated for the second frame. As shown in FIG. 4, for the second frame, high fidelity bins (whose edges are labelled as 402, 304 and 406) are centered around the first frame's calculated clipping threshold (which is edge 304), and bin sizes increase as the input level moves away from the edge 304. In effect, for the second frame: (a) more precision is being assigned to bins closest to the first frame's calculated clipping threshold 304; and (b) the algorithm converges to the correct high fidelity clipping threshold 302, which is shown in FIG. 4 (i) by a diamond shape because it is the high fidelity clipping threshold, (ii) by a square shape because it is the second frame's calculated clipping threshold, and (iii) by a circle because it is a bin edge. For the third frame, FIG. 5's bin allocation results show how high fidelity bins become centered around the second frame's calculated clipping threshold (which is the converged high fidelity clipping threshold 302) using the dynamic histogram technique. Accordingly, the high fidelity clipping threshold 302 is shown in FIG. 5 (i) by a diamond shape because it is the high fidelity clipping threshold, (ii) by a square shape because it is the third frame's calculated clipping threshold, and (iii) by a circle because it is a bin edge.

This dynamic histogram binning is optimal for video since there is a large amount of temporal redundancy between frames. Moreover, it accomplishes at least two purposes: first, it achieves high fidelity on the final clipping thresholds; and second, it has low memory requirements. With conventional histogram binning, those two characteristics are mutually exclusive. The clipping logic utilized in the example implementation is based on energy clipping. With conventional clipping, the number of pixels outside a particular range is counted. A clipping threshold is calculated based on a user-defined clipping sum, e.g., 1% of all pixels in the image. The exemplary energy clipping using dynamic histogram binning on the other hand does not use an out-of-gamut pixel count. Instead, the amount of out-of-gamut intensity is calculated. For instance, the user may define the energy clipping amount to be 1% of the input pixels at full intensity. For an 8-bit input, this implies that 1% of the pixels may be clipped from 255 to 0, or that 2% of the pixels may be clipped from 255 to 128, and so forth. In actuality, the amount of energy clipped is based on the mean energy (average picture level) in each color component. This minimizes the appearance of clipping artifacts.

An example algorithm that can be employed for brightness gain and power calculation by PGC Unit 138 can be as follows:

Brightness Gain Calculation Equations:

$$(\text{Gain})*[(Rt)(Rc)+(Gt)(Gc)+(Bt)(Bc)]\geq 1;$$

$$Ri=(\text{Gain})(Re);$$

$$Gi=(\text{Gain})(Ge);\ \text{and}$$

$$Bi=(\text{Gain})(Gc).$$

$$R\text{min}\leq Ri\leq R\text{max};$$

$$G\text{min}\leq Gi\leq G\text{max};\ \text{and}$$

$$B\text{min}\leq Bi\leq B\text{max}.$$

Power Equations $$(Rt)(Rp)+(Gt)(Gp)+(Bt)(Bp)\leq Np;\ \text{and}$$

$$Rp=Rf(Ri);$$

$$Gp=Gf(Gi);\ \text{and}$$

$$Bp=Bf(Bi).$$

Where:

Rc, Gc, and Bc=clipping threshold for Red, Green, Blue signals respectively (≤1). This employs energy clipping technique with adaptive histogram bins, described below).

Ri, Gi, Bi=relative intensity of Red, Green, Blue LEDs respectively;

Rmin, Gmin, Bmin=minimum relative intensity of Red, Green, Blue LEDs respectively determined by the minimum power that may be applied to each illuminator;

Rmax, Gmax, Bmax=maximum relative intensity of Red, Green, Blue LEDs respectively determined by the maximum power that may be applied to each illuminator;

Gain=brightness gain (≥1);

Rp, Gp, Bp=power for Red, Green, Blue LEDs respectively;

Rt, Gt, Bt=duty cycles for Red, Green, Blue LEDs respectively (e.g., 0.4, 0.45, & 0.15);

Rf, Gf, Bf=function relating relative intensity to power for Red, Green, & Blue LEDs respectively; and Np=nominal power=power when fixed duty cycles are employed.

This exemplary implementation employs a new energy-based clipping technique. The conventional clipping approaches specify the number of pixels to clip. In the energy-based approach, the total energy is clipped equivalent to a percentage of the input resolution at full ON scale. For example, with an 800×600 SVGA input, a clipping percentage=1%, and average picture level at full ON scale (255), the clipping amount can be calculated as follows:

$$\text{The clipping amount} = (\text{input resolution})(\text{full ON scale})(1\%)$$
$$= (800 \times 600)(255)(.01)$$
$$= 1224000.$$

Thus, 1% of the input pixels may be clipped from 255 to zero, or 2% of the input pixels may be clipped from 128 to zero, and so forth. Energy clipping results in minimal temporal variability as clipped objects move in and out of the frame. Conventional, count-based clipping, on the other hand, results in harsh boundaries. In a typical scenario, the clipping may be set to 0.25-1.5% of input resolution. The trade-off is between large gain and loss of highlight detail.

In the exemplary embodiment, a hard clipping threshold is not used and reaction time supports smooth scene change transfer function. It is determined how fast power to each illuminator may change for a given amount of hue (or luma) difference between the current and previous frames. If there is little to no hue/luma change, little to no change in power is enforced. The exemplary embodiment uses the transfer function specification through look-up table and minimum recursive coefficient settings.

Compared to conventional approaches, the exemplary embodiment may be accomplished with a lower number of bit planes (e.g., 24 vs. 64). Fewer bit planes means minimum switching and less power draw from the DMD. The exemplary embodiment does not employ overlapping primaries resulting in a simpler and cost effective power supply. Compared to conventional Automatic Gain Control (AGC), the exemplary embodiment achieves larger gains. AGC gain is given by 1/max(Rc, Gc, Bc). In contrast, the exemplary embodiment accounts for nonlinear relationships between brightness and power of each illuminator using a nonlinear optimization algorithm. With the nonlinear optimization algorithm, color drift (white point variation) are minimized or eliminated.

The following exemplary equation provides an example for calculating clipping threshold for a given color component. The equation can be repeated for each color component.

Let p=user defined % pixels to clip
Let r=resolution of input source
Let apl=average picture level (calculation described above)
Let h[n]=histogram bin count for bin n, 0≤n≤N
Let e_amt=energy clipping amount=(apl)(r)(p)
Let ps=pixel summation
Let ce=clipped energy summation
Let ub[n]=upper threshold of bin h[n]
Let lb[n]=lower threshold of bin h[n]
Let c=clipping threshold
Clipped energy summation ce=0
Pixel Summation ps=0

```
For n=N to 0
  ps=ps+h[n]
  ce=ce+(ps)(ub[n]−lb[N])
  If (ce≥e_amt)
    c=ub[n]
  end
End
```

Above illustration is just an example of calculating clipping threshold for a frame. One skilled in the art will appreciate that the clipping threshold can be calculated in various different ways using concepts and teachings of the exemplary embodiments described herein for optimizing the non-liner relationship of power and image brightness of solid-state illuminators.

Conventional pixel count based clipping results in hard thresholds that produce step-function responses. In other words, flickering artifacts are present in the image. Energy clipping method of exemplary embodiment described herein eliminates the step response of conventional method and produces smooth, flicker-free results. Additionally, by adapting the clipping amount to scene brightness, the appearance of clipping artifacts is minimized.

As described hereinabove, clipping thresholds are filtered to minimize the potential flickering artifacts. An exemplary filtering equations that can be implemented by is given below.

Let Rc, Gc, Bc=clipping thresholds for Red, Green, & Blue signals, normalized between 0 & 1, for the current frame
Let Rc_prev, Gc_prev, Bc_prev=clipping thresholds for Red, Green, & Blue signals, normalized between 0 & 1, for the previous frame
Let Rf, Gf, Bf=filtered clipping thresholds for Red, Green, & Blue signals, normalized between 0 & 1, for the current frame
Let Rf_prev, Gf_prev, Bf_prev=filtered clipping thresholds for Red, Green, & Blue signals, normalized between 0 & 1, for the previous frame
Let sc_amt=scene change amount
Let s[sc_amt]=recursive coefficient transfer function, a programmable look-up table (LUT).
Let r=recursive coefficient, between 0 & 1

$$sc_amt = \text{maximum}(\text{absolute}(Rc - Rc_prev), \text{absolute}(Gc - Gc_prev), \text{absolute}(Bc - Bc_prev))$$

$$r = s[sc_amt]$$

$$Rf = (Rc)(1-r) + (Rf_prev)(r)$$

$$Gf = (Gc)(1-r) + (Gf_prev)(r)$$

$$Bf = (Bc)(1-r) + (Bf_prev)(r)$$

The recursive coefficient transfer function can be programmed to produce small r values (close to 0) for a large sc_amt and large r values (close to 1) for a small sc_amt. This implies that the filtered clipping thresholds can change instantly for a true scene cut and enforce stability when no scene transition is present. These filtered clipping thresholds can then be used to calculate power and gain for the current frame. In the exemplary embodiment, the adaptive histogram bin allocation process uses un-filtered clipping thresholds.

To compensate for non-linear brightness response of solid-state illuminators, an iterative approach can be employed to find the optimal power distribution among illuminators. An exemplary approach is described herein below.

Parameters
Let Rc, Gc, Bc=clipping thresholds for Red, Green, & Blue signals, normalized between 0 & 1
Let Ri, Gi, Bi=relative intensity of Red, Green, & Blue solid-state illuminators, normalized between 0 & 1
Let Rmin, Gmin, Bmin=minimum relative intensity of Red, Green, & Blue illuminators, normalized between 0 & 1. This is determined by the minimum power that may be applied to each illuminator.

Let Rmax, Gmax, Bmax=maximum relative intensity of Red, Green, & Blue illuminators, normalized between 0 & 1. This is determined by the maximum power that may be applied to each illuminator.

Let G=brightness gain (≥1)

Let Rp, Gp, Bp=power for Red, Green, & Blue illuminators

Let Rt, Gt, Bt=duty cycles for Red, Green, & Blue illuminators (each between 0 & 1, sum to 1)

Let Rf, Gf, Bf=function relating relative intensity to power for Red, Green, & Blue illuminators Let Rn, Gn, Bn=function relating power to relative intensity for Red, Green, & Blue illuminators (inverse of Rf, Gf, Bf)

Let Np=nominal power

Let step_size=illumination step size used to maximize power utilization

Constraint Equations

Exemplary Brightness Equations $$(G)[(Rt)(Rc)+(Gt)(Gc)+(Bt)(Bc)]\geq 1$$

Ri=(G)(Rc),
Gi=(G)(Gc),
Bi=(G)(Gc)

$$Rmin\leq Ri\leq Rmax, Gmin\leq Gi\leq Gmax, Gmin\leq Gi\leq Gmax,$$

Exemplary Power Equations $$(Rt)(Rp)+(Gt)(Gp)+(Bt)(Bp)\leq Np$$

Exemplary Iterative Solution

First, the maximum achievable gain is calculated.

PREV_G=0
G=1/maximum(Rc Gc Bc)
iteration=0
While (iteration<max_iteration) AND (absolute(PREV_G−G)≥G_THR)

Continue iterative optimization until either maximum iteration is hit or gain has reached Steady State.

```
  PREV_G=G
  NEW_Rc=Rmin/G
  NEW_Gc=Gmin/G
  NEW_Bc=Bmin/G
```

$$G=1/((Rt)(NEW_Rc)+(Gt)(NEW_Gc)+(Bt)(NEW_Bc))$$

Check to determine if the calculated gain is greater than the user-defined maximum gain

```
If (G>MAX_G)
  G=MAX_G
End
```

Check to determine if the clipping threshold or minimum power parameters are violated.

```
If (NEW_Rc<Rc)
  NEW_Rc=Rc
End
If (NEW_Rc<(Rmin/G))
  NEW_Rc=Rmin
End
If (NEW_Gc<Gc)
  NEW_Gc=Gc
End
If (NEW_Gc<(Gmin/G))
  NEW_Gc=Gmin
End
If (NEW_Bc<Bc)
  NEW_Bc=Bc
End
If (NEW_Bc<(Bmin/G))
  NEW_Bc=Bmin
End
```

$$G=1/[(Rt)(NEW_Rc)+(Gt)(NEW_Gc)+(Bt)(NEW_Bc)]$$

Check to determine if the calculated gain is greater than the user-defined maximum gain

```
If (G>MAX_G)
  G=MAX_G
  End
  iteration=iteration+1
End
```

Ensuring that the total power and power per illuminator are both kept below their maximum settings.

```
Ri=(Rc)(G)
Gi=(Gc)(G)
Bi=(Bc)(G)
max_ratio=maximum(Ri/Rmax Gi/Gmax Bi/Bmax)
if (max_ratio<1)
  max_ratio=1
End
```

Scale all illuminators down to the worst case maximum ratio for correct color balance.

```
Ri=Ri/max_ratio
Gi=Gi/max_ratio
Bi=Bi/max_ratio
Rp=Rf(Ri)
Gp=Gf(Gi)
Bp=Bf(Bi)
current_power=(Rt)(Rp)+(Gt)(Gp)+(Bt)(Bp)
power_ratio=cur_power/max_power
If (power_ratio<1)
  power_ratio=1
End
```

Reducing power to all illuminators equally to get below power requirement.

```
Ri_new=Rn(Rp/power_ratio)
Gi_new=Gn(Gp/power_ratio)
Bi_new=Bn(Bp/power_ratio)
```

Determining which illuminator was reduced by the largest amount and do the same to the other illuminators.

```
max_ratio=maximum(Gi/Gi_new Ri/Ri_new Bi/Bi_new)
Ri=Ri/max_ratio
Gi=Gi/max_ratio
Bi=Bi/max_ratio
```

Adjusting the gain accordingly

```
G=G/max_ratio
iteration=0
desired_power_attained=0
```

While (iteration<max_iteration) AND (desired_power_attained==0)

Increasing the illumination strength on each illuminator equally until maximum allowable power draw is obtained.

```
  Ri_new=(Ri)(step_size)
  Gi_new=(Gi)(step_size)
  Bi_new=(Bi)(step_size)
  Rp_new=Rf(Ri_new)
  Gp_new=Gf(Gi_new)
  Bp_new=Bf(Bi_new)
  current_power_new=(Rt)(Rp_new)+(Gt)(Gp_new)+(Bt)
    (Bp_new)
  G_new=(G)(step_size)
  If  (current_power_new>max_power)|(Ri_new>Rmax)|
    (Gi_new>Gmax)|(Bi_new>Bmax)|
    (Gain_new>max_gain)
  desired_power_attained=1
Else
  Ri=Ri_new
```

```
    Gi=Gi_new
    Bi=Bi_new
    Rp=Rp_new
    Gp=Gp_new
    Bp=Bp_new
    G=G_new
    iteration=iteration+1
    End
End
```

The above exemplary recursive optimization equations can be executed during the vertical blanking of video signal. Once active data is present, the gain, G, is applied to each color component and each illuminator is set to their most optimal power setting, Rp, Gp, & Bp. In the example implementation, the system may be set to either a maximum brightness mode, by setting max_gain to a large value, or to a low power mode, by setting max_gain to unity. By making max_gain programmable, a continuum of options between these two modes is also available.

The described solution allows one to achieve maximum brightness for a given power draw (high brightness mode), minimum power usage for a given brightness (low power mode), or a programmable continuum between these two modes. Moreover, it accomplishes this by keeping the duty cycles constant, avoiding the need for high fidelity control of the time line. Additionally, it accounts for the non-linear brightness response of typical solid-state illuminators.

Figure 6:
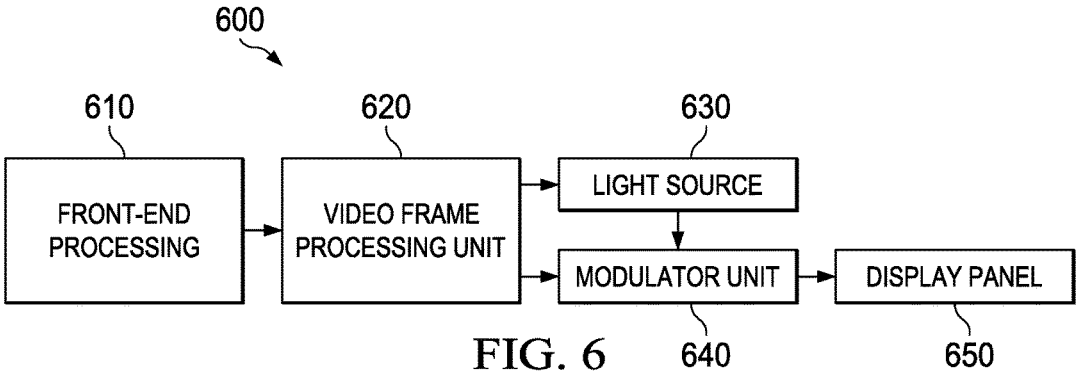
FIG. 6 illustrates an exemplary block diagram of a display system according to some embodiment.

FIG. 6 illustrates an exemplary block diagram of a display system 600 according to some embodiment. Display system 600 includes a front-end processing unit 610 configured to process incoming video signals. The front-end processing unit 610 processes incoming video signals and provides processed video signal to a video processing unit 620. The video processing unit 620 can be any general purpose processor, digital signal processor, microcontroller, application specific integrated circuit, or similar processing unit. The processing unit 620 can include various processing units illustrated in FIG. 1 as individual structural units or programmed functional units configured to perform various tasks described hereinabove in reference to FIG. 1 or a combination thereof. A light source 630 is configured to provide light stimulus to light modulator unit 640. The light modulator unit can include solid-state illuminators such as LEDs, DMDs, and the like. The display plane 650 can be any solid state display configured to display video images.

The foregoing outlines features of several embodiments so that those of ordinary skill in the art may better understand various aspects of the present disclosure. Those of ordinary skill in the art should appreciate that they may readily use the present disclosure as a basis for designing or modifying other processes and structures for carrying out the same purposes and/or achieving the same advantages of various embodiments introduced herein. Those of ordinary skill in the art should also realize that such equivalent constructions do not depart from the spirit and scope of the present disclosure, and that they may make various changes, substitutions, and alterations herein without departing from the spirit and scope of the present disclosure.

Although the subject matter has been described in language specific to structural features or methodological acts, it is to be understood that the subject matter of the appended claims is not necessarily limited to the specific features or acts described above. Rather, the specific features and acts described above are disclosed as example forms of implementing at least some of the claims. Various operations of embodiments are provided herein. The order in which some or all of the operations are described should not be construed to imply that these operations are necessarily order dependent. Alternative ordering will be appreciated having the benefit of this description. Further, it will be understood that not all operations are necessarily present in each embodiment provided herein. Also, it will be understood that not all operations are necessary in some embodiments.

Moreover, "exemplary" is used herein to mean serving as an example, instance, illustration, etc., and not necessarily as advantageous. Also, although the disclosure has been shown and described with respect to one or more implementations, equivalent alterations and modifications will occur to others of ordinary skill in the art based upon a reading and understanding of this specification and the annexed drawings. The disclosure comprises all such modifications and alterations and is limited only by the scope of the following claims. In particular regard to the various functions performed by the above described components (e.g., elements, resources, etc.), the terms used to describe such components are intended to correspond, unless otherwise indicated, to any component which performs the specified function of the described component (e.g., that is functionally equivalent), even though not structurally equivalent to the disclosed structure. In addition, while a particular feature of the disclosure may have been disclosed with respect to only one of several implementations, such feature may be combined with one or more other features of the other implementations as may be desired and advantageous for any given or particular application.

What is claimed is:

1. A method comprising:

calculating a clipping threshold for each color component of an image of a current frame of an incoming video signal based on an intensity level of that color component in the image;

filtering the clipping threshold to generate a filtered clipping threshold; and determining a power level and a gain level for an output video signal based on the filtered clipping threshold.

2. The method of claim 1, wherein filtering the clipping threshold comprises filtering the clipping threshold based on: a previously calculated clipping threshold for an image of a previous frame of the incoming video signal; and a difference between a first histogram of intensity level in pixels of the previous frame and a second histogram of intensity level in pixels of the current frame.

3. The method of claim 1, wherein filtering the clipping threshold comprises filtering the clipping threshold for each color component to generate the filtered clipping threshold for that color component, wherein determining the power level comprises determining the power level for each color component based on the filtered clipping threshold for that color component, and wherein calculating the clipping threshold comprises calculating the clipping threshold for each color component based on an average intensity level of that color component in pixels of the image.

4. The method of claim 1, wherein the filtering further comprises:

computing a histogram of intensity level in pixels of the current frame.

5. The method of claim 4, wherein calculating the clipping threshold comprises calculating the clipping threshold based on bin thresholds in the histogram.

6. The method of claim 5, wherein the bin thresholds are arranged for: higher precision near a previously calculated clipping threshold for an image of a previous frame of the incoming video signal; and lower precision away from the previously calculated clipping threshold.

7. A device comprising:

a histogram unit, configured to calculate a clipping threshold for each color component of an image of a current frame of an incoming video signal based on an intensity level of that color component in the image;

a filter coupled to the histogram unit, configured to filter the clipping threshold to generate a filtered clipping threshold; and a power gain calculator coupled to the filter, configured to determine a power level and a gain level for an output video signal based on the filtered clipping threshold.

8. The device of claim 7, wherein the filter is configured to filter the clipping threshold for each color component to generate the filtered clipping threshold for that color component, wherein the power gain calculator is configured to determine the power level for each color component based on the filtered clipping threshold for that color component, and wherein the histogram unit is configured to calculate the clipping threshold for each color component based on an average intensity level of that color component in pixels of the image.

9. The device of claim 7, wherein the histogram unit is configured to:

compute a histogram of intensity level in pixels of the current frame.

10. The device of claim 9, wherein the histogram unit is configured to calculate the clipping threshold based on bin thresholds in the histogram.

11. The device of claim 10, wherein the bin thresholds are arranged for: higher precision near a previously calculated clipping threshold for an image of a previous frame of the incoming video signal; and lower precision away from the previously calculated clipping threshold.

12. The device of claim 7, wherein the filter is configured to filter the clipping threshold based on: a previously calculated clipping threshold for an image of a previous frame of the incoming video signal; and a difference between a first histogram of intensity level in pixels of the previous frame and a second histogram of intensity level in pixels of the current frame.

13. A system comprising:

a processor configured to:

for each color component of an image of a current frame of an incoming video signal, compute a histogram of intensity level in pixels of the current frame, calculate a clipping threshold for each color component of the image of the current frame of the incoming video signal based on the histogram, and determine a power level and a gain level for an output video signal based on the clipping threshold; and a display panel coupled to the processor, configured to display the output video signal based on the power level and the gain level.

14. The system of claim 13, wherein the histogram is a first histogram, and wherein the processor is configured to filter the clipping threshold based on: a previously calculated clipping threshold for an image of a previous frame of the incoming video signal; and a difference between the first histogram and a second histogram of intensity level in pixels of the previous frame.

15. The system of claim 13, wherein the processor is configured to calculate the clipping threshold for each color component based on an average intensity level of that color component in pixels of the image.

16. The system of claim 13, wherein the system is a sequential color display system.

17. The system of claim 16, wherein the display panel comprises solid-state illuminators having a non-linear response to the power level and the gain level.

* * * * *